United States Patent [19]

Smart

[11] Patent Number: 4,503,113

[45] Date of Patent: Mar. 5, 1985

[54] PAPERMAKER FELT WITH A THREE-LAYERED BASE FABRIC

[75] Inventor: Frederick R. Smart, Averill Park, N.Y.

[73] Assignee: Huyck Corporation, Wake Forest, N.C.

[21] Appl. No.: 357,409

[22] Filed: Mar. 12, 1982

[51] Int. Cl.[3] ..... D03D 11/00; D03D 13/00; D03D 25/00; D21F 7/08

[52] U.S. Cl. ..... 428/234; 139/383 A; 162/358; 162/DIG. 1; 428/257; 428/282

[58] Field of Search ..... 162/358, DIG. 1; 139/383 A; 428/257, 282, 234

[56] References Cited

U.S. PATENT DOCUMENTS

| | | | |
|---|---|---|---|
| 3,214,326 | 10/1965 | Lee | 162/205 |
| 3,657,068 | 4/1972 | Ivanowicz | 162/358 |
| 3,885,603 | 5/1975 | Slaugnter | 162/DIG. 1 |
| 3,928,699 | 12/1975 | Fekete | 482/212 |
| 4,107,367 | 8/1978 | Fekete | 428/282 |
| 4,187,618 | 2/1980 | Diehl | 162/358 |
| 4,283,454 | 8/1981 | Buchanan | 428/282 |
| 4,314,589 | 2/1982 | Buchanan et al. | 162/DIG. 1 |
| 4,333,502 | 6/1982 | Karn | 162/DIG. 1 |
| 4,344,464 | 8/1982 | Thompson et al. | 162/DIG. 1 |
| 4,356,225 | 10/1982 | Duhour | 428/257 |

FOREIGN PATENT DOCUMENTS

| | | |
|---|---|---|
| 1476259 | 4/1966 | France . |
| 2251645 | 11/1974 | France . |
| 1030994 | 6/1963 | United Kingdom . |

*Primary Examiner*—James C. Cannon
*Attorney, Agent, or Firm*—Anthony M. Lorusso

[57] ABSTRACT

Disclosed is a papermakers felt comprising a woven three-layered base fabric construction and a non-woven batting material. The bottom layer of the base fabric is made from coarse yarns with large diameters and the top two layers of fine yarns with smaller diameters. There are fewer yarns in the bottom layer of the base fabric than in either of the top two layers.

23 Claims, 1 Drawing Figure

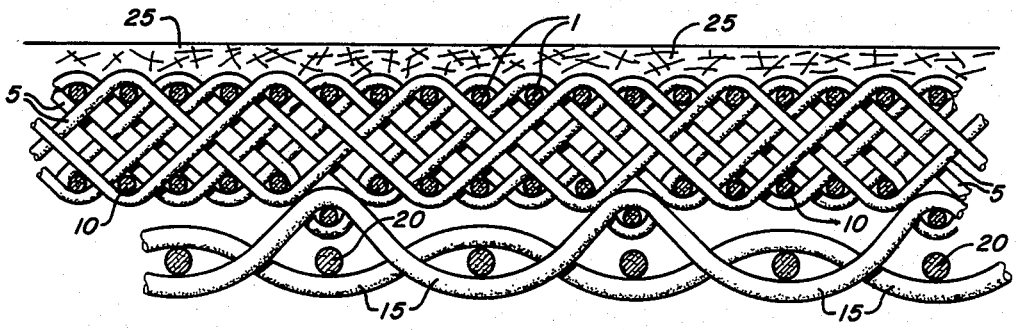
25
1
25
5
5
10
10
20
20
15
15

PAPERMAKER FELT WITH A THREE-LAYERED BASE FABRIC

BACKGROUND OF THE INVENTION

This invention relates to a papermaker's fabric, and more particularly, to a papermaker's press felt with a woven three-layered base fabric construction.

The most common technique for removing water from a paper sheet is by the use of a press wherein the paper sheet and the felt on which it is carried are squeezed between rollers, the felt being formed in such a manner that the water extracted from the paper will press through the felt for discharge. Desirably, the press felt will have relatively large open areas or voids which will enhance the water-containing capability and serve to avoid a backflow of water relative to the direction of motion of the paper web, with consequent "crushing" or hydraulic destruction of the structural integrity of the web.

Various felts have been designed with the objective of providing void space. These felts, though, have other problems as a result of their structure. For example, in a press felt which contains a relatively coarse, incompressible woven base fabric to provide void volume, the very incompressibility of the yarn comprising the base fabric, acting as intermittent backing elements to the associated fibrous batt layer, tends to produce regions of varying pressure as the fabric passes through the press nip. Since a smaller portion of the surface area of the paper is effectively exposed to pressure being exerted upon it than if the fibrous layer were more uniformly supported underneath by the base fabric, the felt is less effective as a water removal device and surface marks are sometimes introduced in the paper.

Accordingly, it is an object of this invention to provide a papermaker's felt that will avoid "crushing" of the web by providing void volume through the nip between press rolls.

It is a further object of this invention to provide a papermaker's felt in which the pressure exerted by the felt on the paper is uniform, without localized hard spots which are likely to produce marks in the paper.

It is still a further object of this invention to provide a papermaker's felt having an enhanced capacity for removing water from a paper sheet.

SUMMARY OF THE INVENTION

The problems of the prior art are overcome by the present invention which provides a papermaker's press felt comprising a woven three-layered base fabric construction and a non-woven batting material.

The bottom layer of the woven three-layered base fabric is made from yarns which are coarse in comparison to the yarns in the top two layers. There are less yarns in the bottom layer of the base fabric than in either of the top two layers and the yarns in the bottom layer have a greater diameter than the yarns in the top two layers.

The three-layered base fabric may be woven endless using two warp beams and three or more shuttles, or the base layer and the upper two layers may be woven as two separate fabrics and later combined through needling. Following formation of the base fabric, non-woven batting material is needled to the face side of the fabric.

These and other objects and features of the invention will be apparent from the following description of a preferred embodiment and from the drawing.

BRIEF DESCRIPTION OF THE DRAWING

The FIGURE is a diagrammatic view of a papermaker's felt embodying the invention.

DESCRIPTION OF THE PREFERRED EMBODIMENT

The FIGURE shows a papermaker's felt with a three-layered base fabric. The base fabric may be manufactured in several fashions. For example, it may be woven endless, as in the FIGURE using two warp beams and three or more shuttles, or the base layer and the upper two layers may be woven separately as two separate fabrics and later combined through needling.

The uppermost cross machine direction yarn 5 indicates the two top fabric layers. The bottom layer is connected to the middle layer by interlacing of the bottom cross machine direction yarn 15 around the middle machine direction yarn 10 at various intervals. In the FIGURE there is such an interlacing after every six middle machine direction yarns 10 or every other bottom machine direction yarn 20. The interlacings are generally designed such that they are hidden from view by an underlying bottommost machine direction yarn. This arrangement protects the interlacing junction from abrasive wear during operation on the paper machine.

The bottom layer of the woven three-layered base fabric which receives the water from the paper is made from substantially coarse yarns and serves as a wear surface. The coarse yarns in the bottom layer provide void volume to enhance the water-containing capability of the press felt. There are less yarns in the bottom layer than in either of the top two layers and the yarns in the bottom layer have a greater diameter than the yarns in the top two layers. This results in large unimpeded voids in the bottommost layer. The yarns in the upper two layers are substantially smaller in diameter than the yarns in the bottom layer in order to insure adequate distribution of pressure to the upper batt layer.

In the bottom layer, there are roughly eight yarns per inch in both the machine direction and the cross-machine direction. In the top layer, there are between 14 to 32 yarns per inch in both the machine direction and the cross-machine direction. The ratio of yarns in the top layer to the bottom layer is thus between approximately two to one and four to one. The machine direction yarn count in the middle layer is either the same as in the upper layer or less than the upper layer but more than the bottom layer.

The top two layers of the base fabric provide load bearing strength for the press felt. The top two layers of the base fabric are made from smaller diameter, much finer yarns than the yarns in the bottom layer. The uppermost machine direction yarn 1 and middle machine direction yarn 10 provide adequate bridging over the bottom fabric layer and together with the upper cross-machine direction yarn 5, uniform pressure distribution to the adjoining batt layer.

Instead of a coarse non-compressible base fabric which produces regions of localized high pressure, the base fabric of the invention consists of a coarse bottom layer and two finer top layers. This three-layered base fabric makes the pressure exerted by the felt on the paper more nearly uniform, without localized hard spots which are likely to produce marks in the paper.

Additionally, the felt is more efficient as a water removal device since a greater portion of the surface area of the paper is effectively exposed to the pressure being exerted upon it by the felt.

The uppermost cross-machine direction yarn 5, interlacing the two top fabric layers is chosen on the basis of imparting fabric stability, adequate bridging over the bottommost fabric layer and uniform pressure distribution to the adjoining upper batt layers. A monofilament, or twisted monofilament yarn, would typically be used for this purpose.

The cross-machine direction yarn 15 in the bottom fabric layer would be chosen primarily on the basis of providing adequate wear resistance and protection for the two upper fabric layers. Typically, this yarn would be composed of multifilament, resin treated multifilament, or staple fibers.

The bottom machine direction yarn 20 is chosen on the basis of providing wear resistance. As with the bottom cross-machine direction yarn, this would typically be a multifilament, resin treated multifilament, or staple type.

The machine direction yarn 10 in the middle fabric layer is chosen on the basis of providing load bearing strength, stability, and resistance to compaction. This yarn would typically be a monofilament, twisted monofilament, or resin treated multifilament type.

The uppermost machine direction yarn 1, in some applications, may be identical to the machine direction yarn 10 used in the middle layer. When greater pressure uniformity is required, a softer, more compressible yarn such as staple or low twist multifilament is used. The weight and diameter of this yarn 1 is essentially similar to that of the machine direction yarn 10 used in the middle layer.

The two upper fine layers over the bottom coarse layer provide more load bearing strength than would a single fine layer. In addition, the uppermost fine layer is not contaminated by any coarse yarns from the bottom layer of the base fabric since the interlacing of the coarse and fine yarns takes place in the intermediate layer.

Following formation of the three-layered base fabric, the press felt is completed by needling a non-woven batting materal 25 to the face side of the fabric, which batting material defines the paper supporting surface of the felt. Normally the non-woven batting material is placed such that there is minimum penetration into the bottommost coarse layer in order to preserve large, unimpeded void spaces within this layer.

The invention is further illustrated by the following non-limiting example.

EXAMPLE 1

A three-layered base fabric is woven endless using two warp beams and three shuttles. The uppermost cross-machine direction (CMD) yarn interlaces the two top fabric layers. The bottom layer is connected to the middle layer by interlacing of the bottom CMD yarn around every sixth middle machine direction (MD) yarn.

A single uppermost MD yarn consists of 6 strands of polyamide monofilament 0.008" in diameter twisted together to form a yarn 0.028" in diameter. The uppermost MD yarns are woven 24 yarns per inch. The middle MD yarns are identical in size and type to the uppermost MD yarns and are also woven 24 yarns per inch. A single uppermost CMD yarn consists of 4 strands of 0.008" polyamide monofilament twisted together to form a yarn 0.021" in diameter. The uppermost CMD yarns are also woven 24 yarns per inch. Three plies of 1700 denier staple yarn form a single bottommost MD yarn 0.057" in diameter. The bottommost MD yarn components consist of 60% by weight of 6 denier polyamide fibers and 40% by weight of polypropylene 6 denier fibers. The bottommost MD yarns are woven at 8 yarns per inch. The bottommost CND yarns are identical in size and type to the bottommost MD yarns and are also woven at 8 yarns per inch.

While this invention has been described with reference to its preferred embodiment, other emdobiments can achieve the same result. Variations and modifications of the present invention will become obvious to those skilled in the art and it is intended to cover the appending claims all such modifications espoused in the true spirit and scope of this invention.

I claim:

1. A papermaker's felt comprising:

a non-woven batting material; and a woven three-layer base fabric comprising:

a bottom layer of cross-machine direction and machine direction yarns;

a middle layer of fine yarns which has a higher cross-machine direction and machine direction yarn count than the bottom layer and in which the cross-machine direction and machine direction yarn diameters are smaller than the diameters of the cross-machine direction and machine direction yarns in the bottom layer; and a top layer of fine yarns in which every cross-machine direction yarn is also a cross-machine direction yarn in the middle layer and in which the machine direction yarn count is the same as or higher than the machine direction yarn count of the middle layer, the diameters of the machine direction yarns of the top layer being the same as or less than the diameters of the machine direction yarns of the middle layer.

2. The papermaker's felt of claim 1 wherein the non-woven batting material is needled to the top two layers of the woven three-layered base fabric.

3. The papermaker's felt of claim 1 wherein the cross-machine direction yarn in the upper two layers interlaces the two top fabric layers.

4. The papermaker's felt of claim 1 wherein the bottom layer is connected to the middle layer by interlacing of the bottom crossmachine direction yarn around the middle machine direction yarn at various intervals.

5. The papermaker's felt of claim 1 wherein the bottom layer contains eight yarns per inch in both the machine direction and the cross-machine direction.

6. The papermaker's felt of claim 1 wherein there are at least twice as many machine direction and cross-machine direction yarns per inch in either of the upper layers as there are in the bottom layer.

7. The papermaker's felt of claim 1 wherein the cross-machine direction yarn interlacing the two top fabric layers is a monofilament.

8. The papermaker's felt of claim 1 wherein the cross-machine direction yarn interlacing the two top fabric layers is a twisted monofilament.

9. The papermaker's felt of claim 1 wherein the cross-machine direction yarn in the bottom layer is comprised of multi-filament fibers.

10. The papermaker;3 s felt of claim 1 wherein the cross-machine direction yarn in the bottom layer is comprised of resin treated multifilament fibers.

11. The papermaker's felt of claim 1 wherein the cross-machine direction yarn in the bottom layer is comprised of staple fibers.

12. The papermaker's felt of claim 1 wherein the machine direction yarn in the bottom layer is comprised of multi-filament fibers.

13. The papermaker's felt of claim 1 wherein the machine direction yarn in the bottom layer is comprised of resin treated multifilament fibers.

14. The papermaker's felt of claim 1 wherein the machine direction yarn in the bottom layer is comprised of staple fibers.

15. The papermaker's felt of claim 1 wherein the machine direction yarn in the middle layer is a monofilament.

16. The papermaker's felt of claim 1 wherein the machine direction yarn in the middle layer is a twisted monofilament.

17. The papermaker's felt of claim 1 wherein the machine direction yarn in the middle layer is comprised of resin treated multifilament.

18. The papermaker's felt of claim 1 wherein the machine direction yarn in the top layer is a monofilament.

19. The papermaker's felt of claim 1 wherein the machine direction yarn in the top layer is a twisted monofilament.

20. The papermaker's felt of claim 1 wherein the machine direction yarn in the top layer comprises resin treated multifilaments.

21. The papermaker's felt of claim 1 wherein the machine direction yarn in the top layer comprises staple or low twist multifilament fibers.

22. The papermaker's felt of claims 1, 2, 3, 4, 5, 6, 7, 8, 9, 10, 11, 12, 13, 14, 15, 16, 17, 18, 19, 20 or 21 wherein the three-layered base fabric is woven endless using two warp beams and three or more shuttles.

23. The papermaker's felt of claims 1, 2, 3, 4, 5, 6, 7, 8, 9, 10, 11, 12, 13, 14, 15, 16, 17, 18, 19, 20 or 21 wherein the base layer and the upper two layers are woven separately and the two fabrics are then later combined through needling.

* * * * *